US010842263B1

(12) United States Patent
Chen

(10) Patent No.: US 10,842,263 B1
(45) Date of Patent: Nov. 24, 2020

(54) COMBINATIVE SHELVING UNIT

(71) Applicant: Tong-Fu Chen, Taipei (TW)

(72) Inventor: Tong-Fu Chen, Taipei (TW)

( * ) Notice: Subject to any disclaimer, the term of this patent is extended or adjusted under 35 U.S.C. 154(b) by 0 days.

(21) Appl. No.: 16/728,524

(22) Filed: Dec. 27, 2019

(51) Int. Cl.

| | |
|---|---|
| ***A47B 47/00*** | (2006.01) |
| ***A47B 55/02*** | (2006.01) |
| ***A47B 45/00*** | (2006.01) |
| *A47F 5/01* | (2006.01) |
| *A47B 57/06* | (2006.01) |
| *A47B 57/00* | (2006.01) |
| *B65D 1/38* | (2006.01) |

(52) U.S. Cl.
CPC ..... *A47B 47/0091* (2013.01); *A47B 45/00* (2013.01); *A47B 47/0083* (2013.01); *A47B 55/02* (2013.01); *A47B 47/00* (2013.01); *A47B 57/00* (2013.01); *A47B 57/06* (2013.01); *A47F 5/01* (2013.01); *B65D 1/38* (2013.01)

(58) Field of Classification Search
CPC . A47B 47/0091; A47B 55/02; A47B 47/0083; A47B 45/00; A47B 47/00; A47B 57/06; A47B 57/00; A47F 5/01; B65D 1/38
USPC ..... 211/181.1, 187
See application file for complete search history.

(56) References Cited

U.S. PATENT DOCUMENTS 2,315,595 A * 4/1943 Chappory ..... A47F 5/13 211/186
D165,118 S * 11/1951 Strinning ..... D6/570
D180,883 S * 8/1957 Perry ..... D7/704
2,903,137 A * 9/1959 Brown ..... A47B 55/02 211/26
3,097,615 A * 7/1963 Ross ..... A47B 55/02 108/155
3,200,959 A * 8/1965 Theim ..... A47F 5/01 211/50
3,208,408 A * 9/1965 Maslow ..... A47F 5/13 108/148
3,232,442 A * 2/1966 Wilson ..... A47F 5/01 211/133.2
3,252,434 A * 5/1966 Young, Jr. ..... A47F 5/13 108/181
3,280,989 A * 10/1966 Melvin ..... A47F 5/01 211/133.2
3,316,864 A * 5/1967 Maslow ..... A47B 57/54 108/148
D209,490 S * 12/1967 Baxter ..... D34/21
(Continued)

*Primary Examiner* — Jonathan Liu
*Assistant Examiner* — Devin K Barnett
(74) *Attorney, Agent, or Firm* — Chun-Ming Shih; HDLS IPR Services

(57) ABSTRACT

A combinative shelving unit includes two stand assemblies and a load tray. The two stand assemblies are arranged parallel to each other. Each stand assembly includes a pair of posts and a transverse link connected between the pair of posts. Each transverse link has a first assembling portion and a second assembling portion. One side of the load tray has a connecting portion and another side thereof has a second connecting portion. The first connecting portion and the second connecting portion are staggered in position. The first connecting portion engages with the first assembling portion of one of the transverse links, and the second connecting portion engages with the second assembling portion of another one of the transverse links.

11 Claims, 11 Drawing Sheets

(56) References Cited

U.S. PATENT DOCUMENTS 3,589,746 A * 6/1971 Inglis ..... A47B 57/12 280/79.3
3,680,712 A * 8/1972 Jurasek ..... A47F 5/13 211/59.2
3,884,358 A * 5/1975 Marschak ..... A47B 96/06 211/186
3,915,097 A * 10/1975 Young, Jr. ..... A47F 5/13 108/6
3,977,529 A * 8/1976 Stroh ..... A47F 5/135 211/187
4,191,160 A * 3/1980 Elliott ..... A47J 37/0763 126/25 R
4,313,544 A * 2/1982 Ashton ..... A47F 5/13 108/163
4,915,462 A * 4/1990 Le Marchand ..... B62B 3/004 312/249.8
5,065,873 A * 11/1991 Tseng ..... A47B 57/54 211/187
5,221,014 A * 6/1993 Welch ..... A47B 55/02 211/181.1
5,251,973 A * 10/1993 Hazan ..... A47B 61/00 211/186
5,326,062 A * 7/1994 Remmers ..... A47B 55/02 211/106
5,718,441 A * 2/1998 Kern ..... A47B 57/14 211/187
D405,627 S * 2/1999 Salvucci ..... D6/675.2
5,913,270 A * 6/1999 Price ..... A47J 37/0763 108/101
6,079,575 A * 6/2000 Wang ..... A47B 55/02 108/110
6,095,347 A * 8/2000 Mauro-Vetter ..... B65G 1/08 211/151
6,135,299 A * 10/2000 Burgess ..... A47B 46/00 211/150
6,318,570 B1 * 11/2001 Mueller ..... A47B 87/0207 211/126.7
D584,906 S * 1/2009 Vanderheyden ..... D6/675.5
7,533,948 B2 * 5/2009 Smith ..... A47B 55/02 108/107
7,857,329 B2 * 12/2010 Cai ..... B62B 3/04 280/47.35
7,967,157 B2 * 6/2011 Bilotto ..... A47F 5/16 211/194
8,025,163 B2 * 9/2011 McAllister ..... A47B 96/028 211/90.03
8,196,761 B2 * 6/2012 Morandi ..... A47B 47/024 211/186
8,267,261 B2 * 9/2012 Vanderhoek ..... A01G 9/143 211/150
8,505,933 B2 * 8/2013 Bernard ..... B62B 3/006 280/33.998
8,640,893 B2 * 2/2014 Kessell ..... A47B 47/0083 211/187
8,739,986 B2 * 6/2014 Preidt ..... A47F 5/00 211/188
9,004,300 B1 * 4/2015 Morrell ..... A47B 57/20 211/187
D746,089 S * 12/2015 Hsu ..... D6/683
9,247,834 B1 * 2/2016 Lucht ..... A47B 47/0083
9,987,876 B1 * 6/2018 Tuang ..... A47B 47/0091
10,561,297 B2 * 2/2020 Maslana ..... A47B 96/021
2002/0130098 A1 * 9/2002 Simard ..... A47F 5/01 211/181.1
2006/0032829 A1 * 2/2006 Hutzler ..... A47B 55/02 211/187
2006/0157435 A1 * 7/2006 Oberhaus ..... A47F 5/01 211/187
2007/0034584 A1 * 2/2007 Park ..... A47B 47/0083 211/187
2007/0210025 A1 * 9/2007 Oberhaus ..... A47F 5/13 211/181.1
2009/0152225 A1 * 6/2009 Lee ..... A47B 87/008 211/187
2010/0288717 A1 * 11/2010 Morandi ..... A47B 43/00 211/187
2011/0233164 A1 * 9/2011 Chang ..... A47B 87/001 211/188
2019/0133413 A1 * 5/2019 Maslana ..... A47L 19/04
2020/0214443 A1 * 7/2020 Cheng ..... A47B 47/0083

* cited by examiner

COMBINATIVE SHELVING UNIT

BACKGROUND OF THE INVENTION

Technical Field

The invention relates to a shelving unit with cost-saving, modularized expansion and easy assembly, particularly to a combinative shelving unit.

Related Art

Shelving storage units are popularly used in houses, stores and warehouses for storing items. With the trend of modern decoration design tending towards personalization and customization, it becomes more necessary for shelves to have expansibility and variability in design.

However, current self-assembling shelving units in the market usually require bolts and/or screws for fixtures. This makes both assembling and disassembling the shelving units time consuming and laborious. As a result, users always feel that the experience is inconvenient and inefficient. In addition, when the number of conventional shelving units needs to be changed, the shelves can only be altered vertically, and any horizontal expansion or reduction is unavailable. This causes poor variability in customization.

SUMMARY OF THE INVENTION

An object of the invention is to provide a combinative shelving unit, which has features of tool-free, cost-saving, modularized expansion and easy assembly.

To accomplish the above object, the combinative shelving unit of the invention includes two stand assemblies and a load tray. The two stand assemblies are arranged parallel to each other. Each stand assembly includes a pair of posts and a transverse link connected between the pair of posts. Each transverse link has a first assembling portion and a second assembling portion. One side of the load tray has a connecting portion and another side thereof has a second connecting portion. The first connecting portion and the second connecting portion are staggered in position. The first connecting portion engages with the first assembling portion of one of the transverse links, and the second connecting portion engages with the second assembling portion of another one of the transverse links.

Accordingly, four stand assemblies can be vertically assembled to adjust the overall height of the combinative shelving unit. This can improve expansibility and variability of a combinative shelving unit.

Accordingly, three stand assemblies can be horizontally assembled to adjust the overall width of the combinative shelving unit. This can improve the expansibility and variability of a combinative shelving unit and its structural strength and save the number of components required.

DETAILED DESCRIPTION OF THE INVENTION

Figure 1:
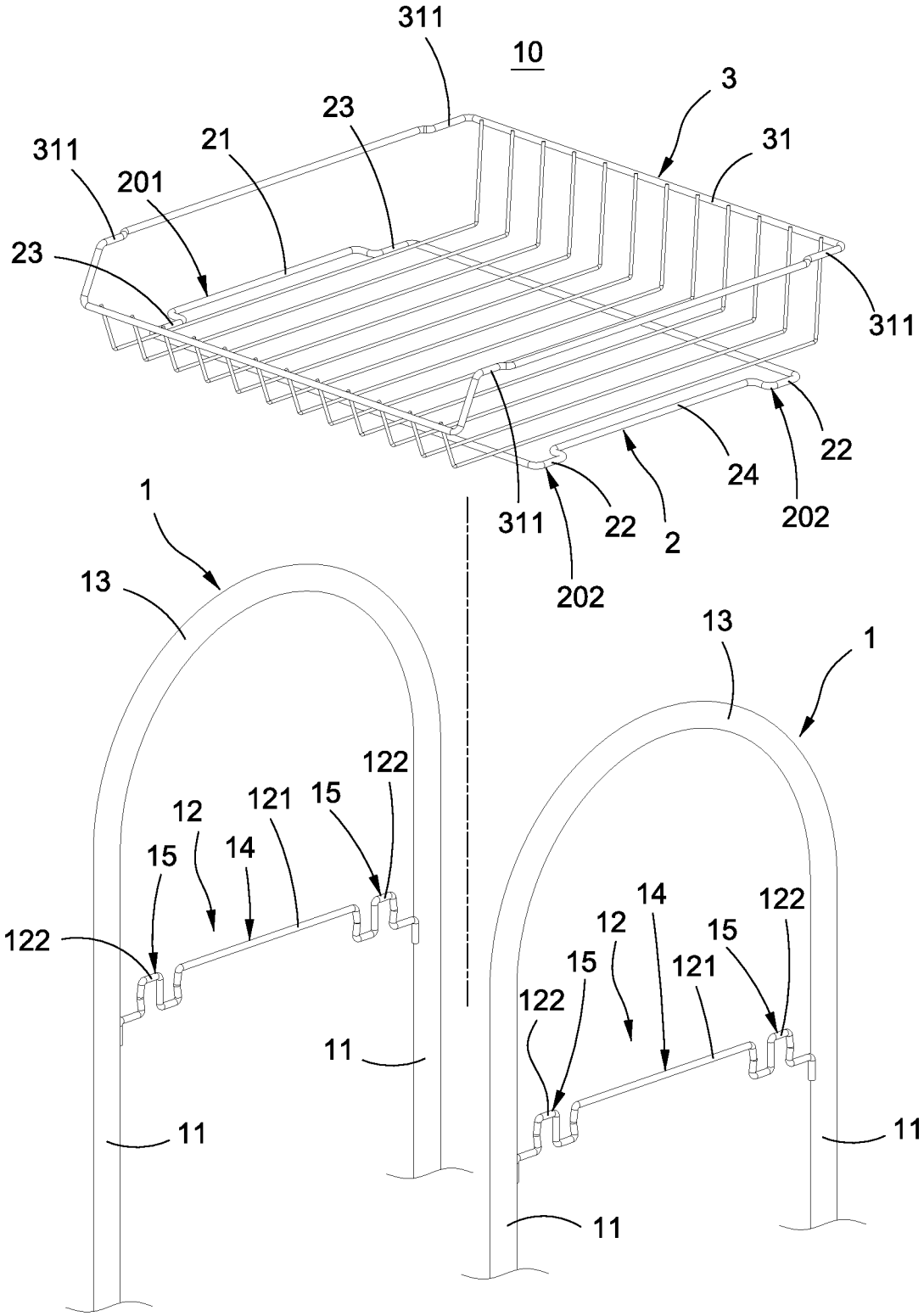
FIG. 1 is a partially exploded view of the first embodiment of the invention.
Figure 2:
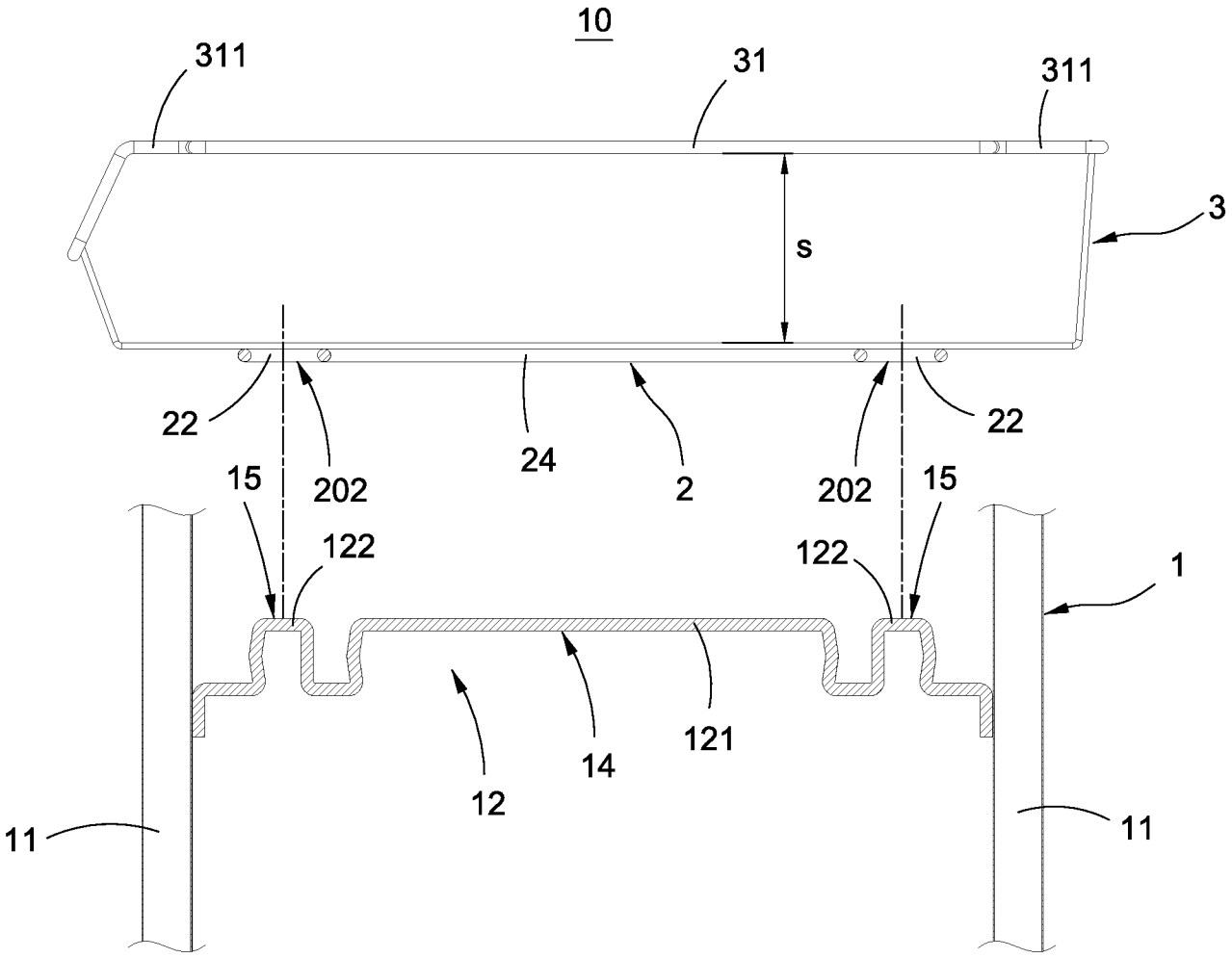
FIG. 2 is a partially cross-sectional and exploded view of the first embodiment of the invention.

Please refer to FIGS. 1-5. The invention provides the first embodiment of a combinative shelving unit. The combinative shelving unit 10 includes two or more stand assemblies 1 and one or more load trays 2.

As shown in FIGS. 1-5, the number of the stand assemblies 1 is two. The two stand assemblies 1 are arranged to be parallel to each other. Each stand assembly 1 includes a pair of posts 11 and one or more transverse links 12 connected between the pair of posts 11. Each transverse link 12 has one or more first assembling portions 14 and one or more second assembling portions 15.

In detail, in this embodiment, the number of the first assembling portion 14 is one and the number of the second assembling portions 15 is two. The two assembling portions 15 are arranged at two opposite ends of the first assembling portion 14. The first assembling portion 14 is a first inverted-U section 121 which is bent upward from the transverse link 12. The two second assembling portions 15 are two inverted-U sections 122 which are bent upward from the transverse link 12.

In addition, each stand assembly 1 includes a U-shaped rod 13, and each pair of posts 11 is separately formed at two ends of the U-shaped rod 13. In this embodiment, two ends of each transverse link 12 are fixed to two ends of one of the pairs of posts 11 by welding, but are not limited to this. Two ends of each transverse link 12 are fixed to two ends of one of the pairs of posts 11 by welding, telescopically connecting them or connecting them in another manner.

As shown in FIGS. 1-5, one side of the load tray 2 has one or more connecting portions 201 and another side thereof has one or more second connecting portions 202. The first connecting portion 201 and the second connecting portion 202 are staggered in position. The first connecting portion 201 engages with the first assembling portion 14 of one of the transverse links 12. The second connecting portion 202 engages with the second assembling portion 15 of another one of the transverse links 202.

In detail, in this embodiment, the number of the first connecting portion 201 is one and the number of the second connecting portions 201 is two. The first connecting portion 201 is a first protrusion section 21 bent outward from the load tray 2. The two second connecting portions 202 are two second protrusion sections 22 bent outward from the load tray 2. The first protrusion section 21 engages with the first inverted-U section 121 of one of the transverse links 12. The two second protrusion sections 22 separately engage with the two second inverted-U sections 122 of another one of the transverse links 12.

In addition, each of two opposite sides of the first protrusion section 21 of the load tray 2 is formed with a first recess section 23 for receiving one of the second protrusion sections 22, and a second recess section 24 for receiving the first protrusion section 21 is formed between the two second protrusion sections 22 of the load tray 2.

In this embodiment, the load tray 2 is multiple in number. Multiple load trays 2 are vertically arranged and the number of multiple load trays 2 may be changed.

As shown in FIGS. 1-3 and 5, the combinative shelving unit 10 of the invention further includes one or more baskets 3, which are the same as the load trays 2 in number. Each basket 3 is fastened on the load tray 2 by welding or screwing.

In detail, the basket 3 has an annular frame 31 disposed on the load tray 2. A height difference s is formed between the annular frame and the load tray 2. The annular frame 31 is bent to form four indents 311, which separately abut against the two pairs of posts 11 so as to make the annular frame tightly disposed between the two pairs of posts 11. The height difference s exists between the annular frame 31 and the load tray 2 and the annular frame 31 abuts against the two pairs of posts 11, so the basket 3 is fastened between the two pairs of posts 11 in a three-dimensional manner and structural strength of the basket 3 can be stiffened to prevent the basket 3 from tilting. Also, the annular frame 31 is bent to form four indents 311 and the four indents 311 separately abut against the two pairs of posts 11 to further enhance the structural strength of the basket 3.

Figure 3:
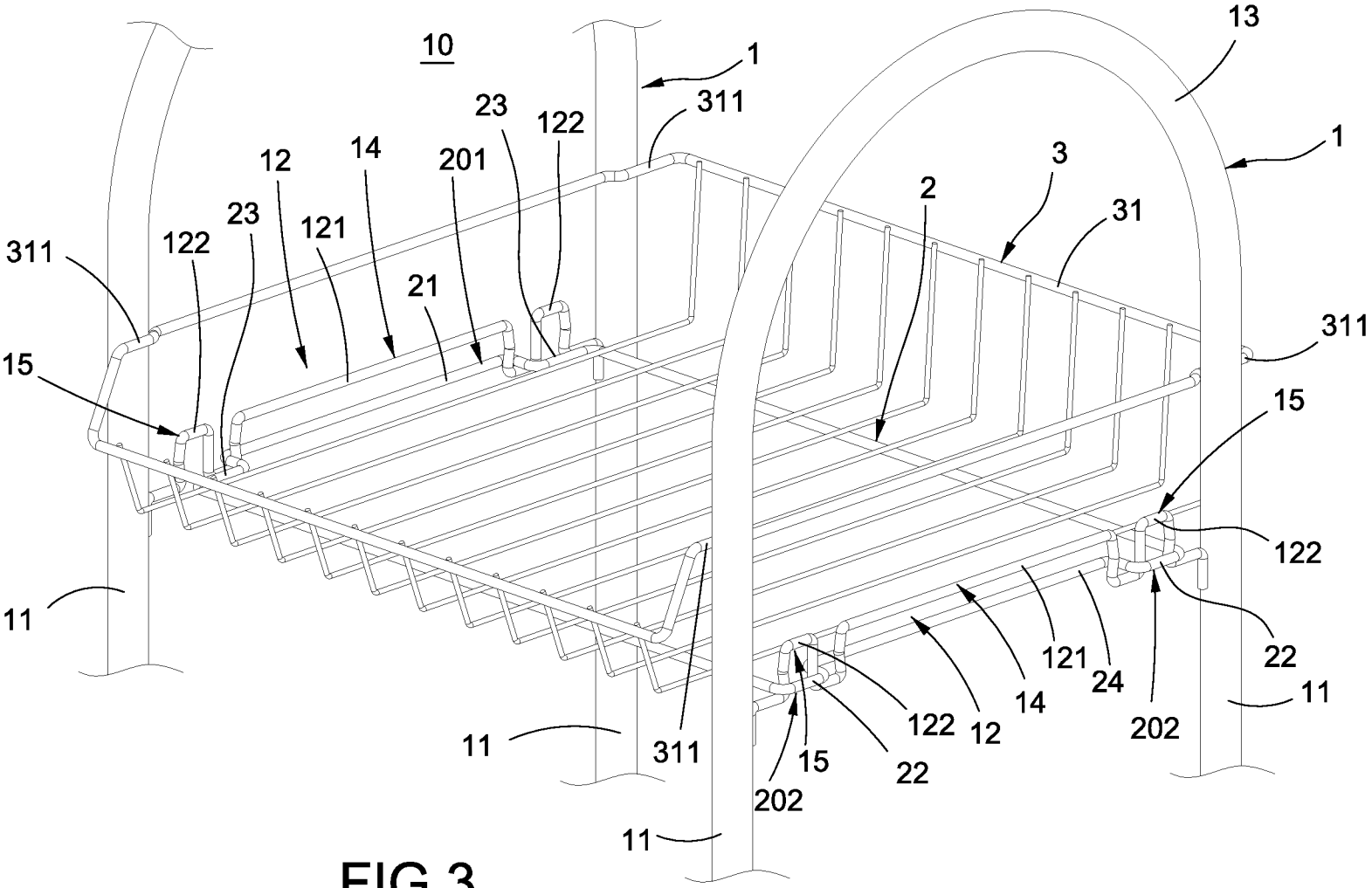
FIG. 3 is a partially perspective assembled view of the first embodiment of the invention.
Figure 4:
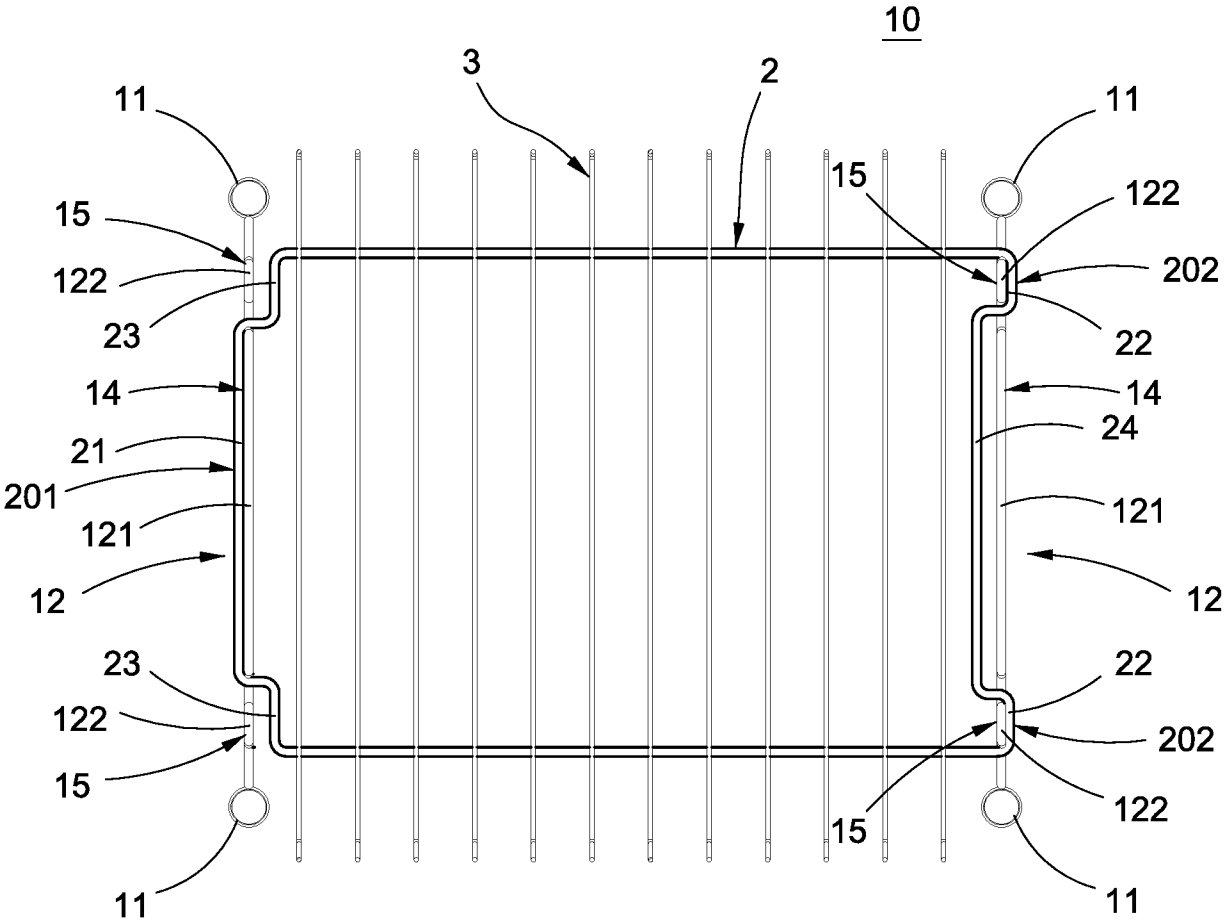
FIG. 4 is a cross-sectional assembled view of the first embodiment of the invention.
Figure 5:
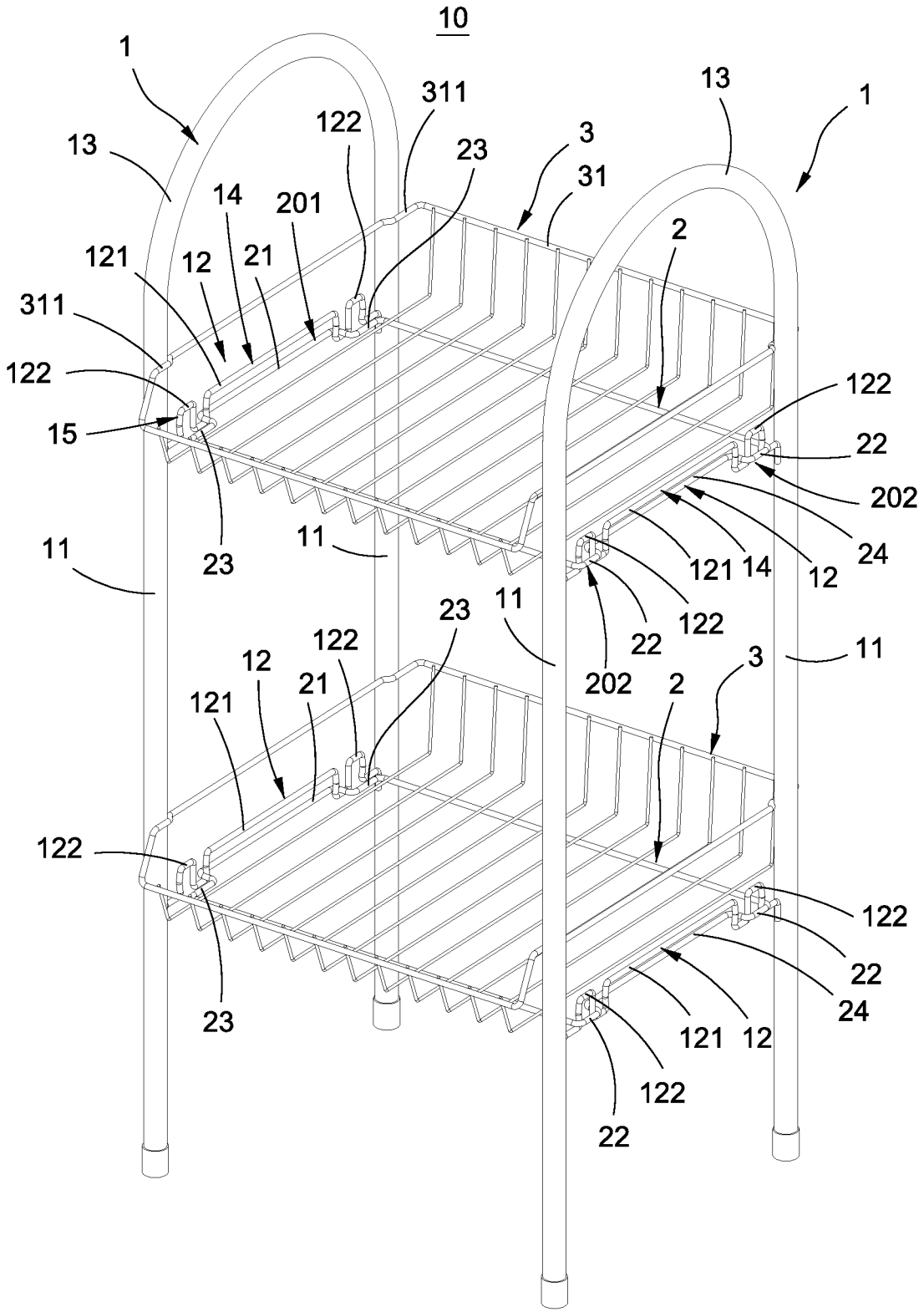
FIG. 5 is a perspective assembled view of the first embodiment of the invention.
Figure 6:
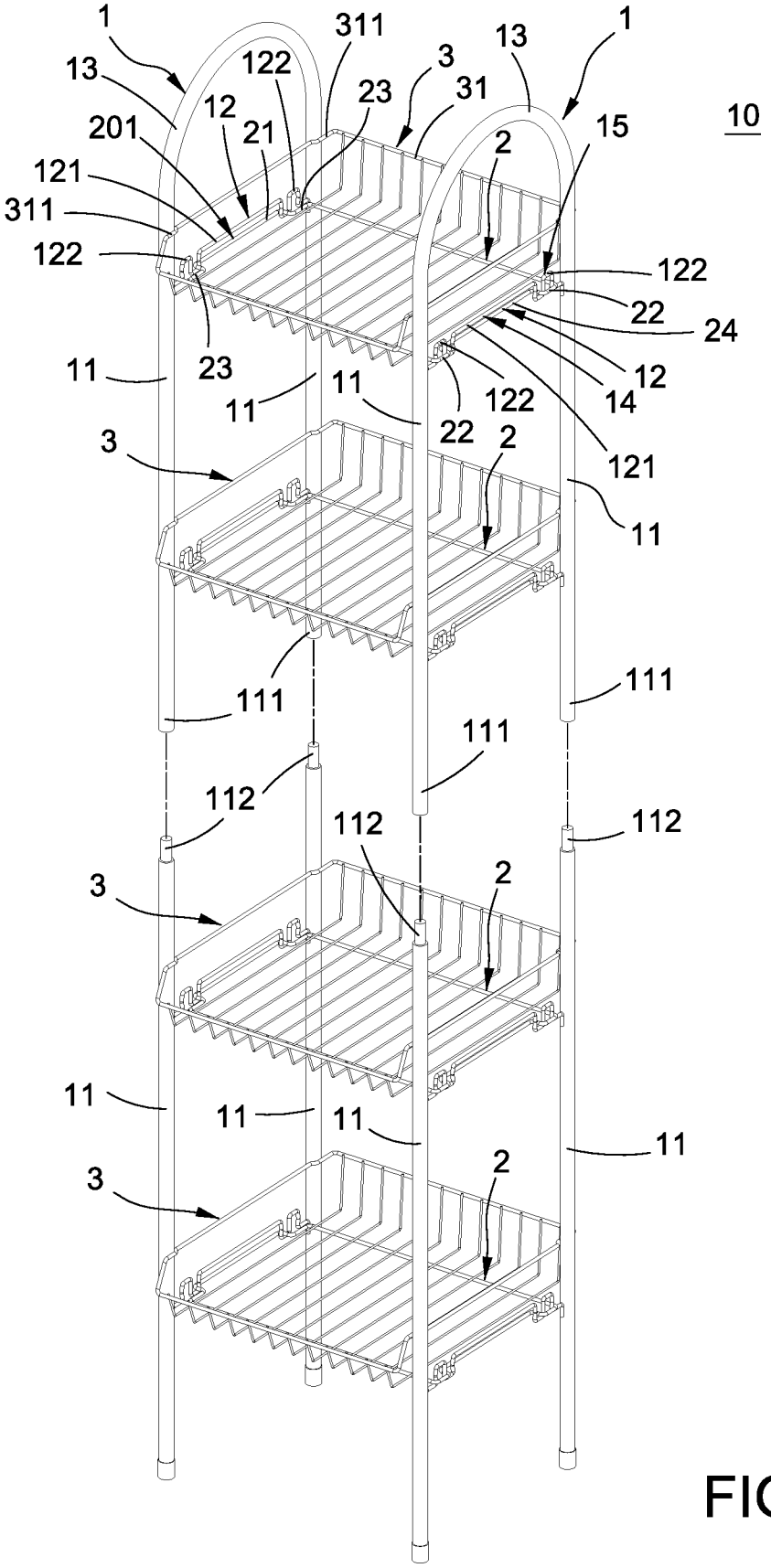
FIG. 6 is a perspective exploded view of the second embodiment of the invention.

As shown in FIGS. 3-5, when using the combinative shelving unit 10 of the invention, parallelly arrange two stand assemblies 1 first, and then engage a first protrusion section 21 at a side of the load tray 2 with the first inverted-U section 121 of one of the transverse links 12 and engage two second protrusion sections 22 at another side with two second inverted-U sections 122 of another one of the transverse links 12 to finish assembly of the combinative shelving unit 10. Thereby, the combinative shelving unit 10 of the invention does not require screwing for fixture, and saves time and labor so as to accomplish the advantages of cost-saving, modularized expansion and easy assembly. Please refer to FIG. 6, which shows the second embodiment of the combinative shelving unit 10 of the invention. The second embodiment is approximately identical to the first embodiment. The second embodiment differs from the first embodiment by the number of the stand assemblies 1 being four.

In detail, the stand assemblies 1 are four in number. The four stand assemblies 1 are arranged to be upper, lower, left and right. Each of bottom ends of upper four posts 11 is provided with a sleeve tube 111. Each of top ends of lower four posts 11 is provided with an insert tube 112. Each sleeve tube 111 is detachably connected with one of the insert tubes 112 so as to make the upper pair of posts 11 detachably connected on the lower pair of posts 11. Thereby, the four stand assemblies 1 can be vertically connected to adjust the overall height of the combinative shelving unit 10 and increase expansibility and variability of the combinative shelving unit 10.

Figure 7:
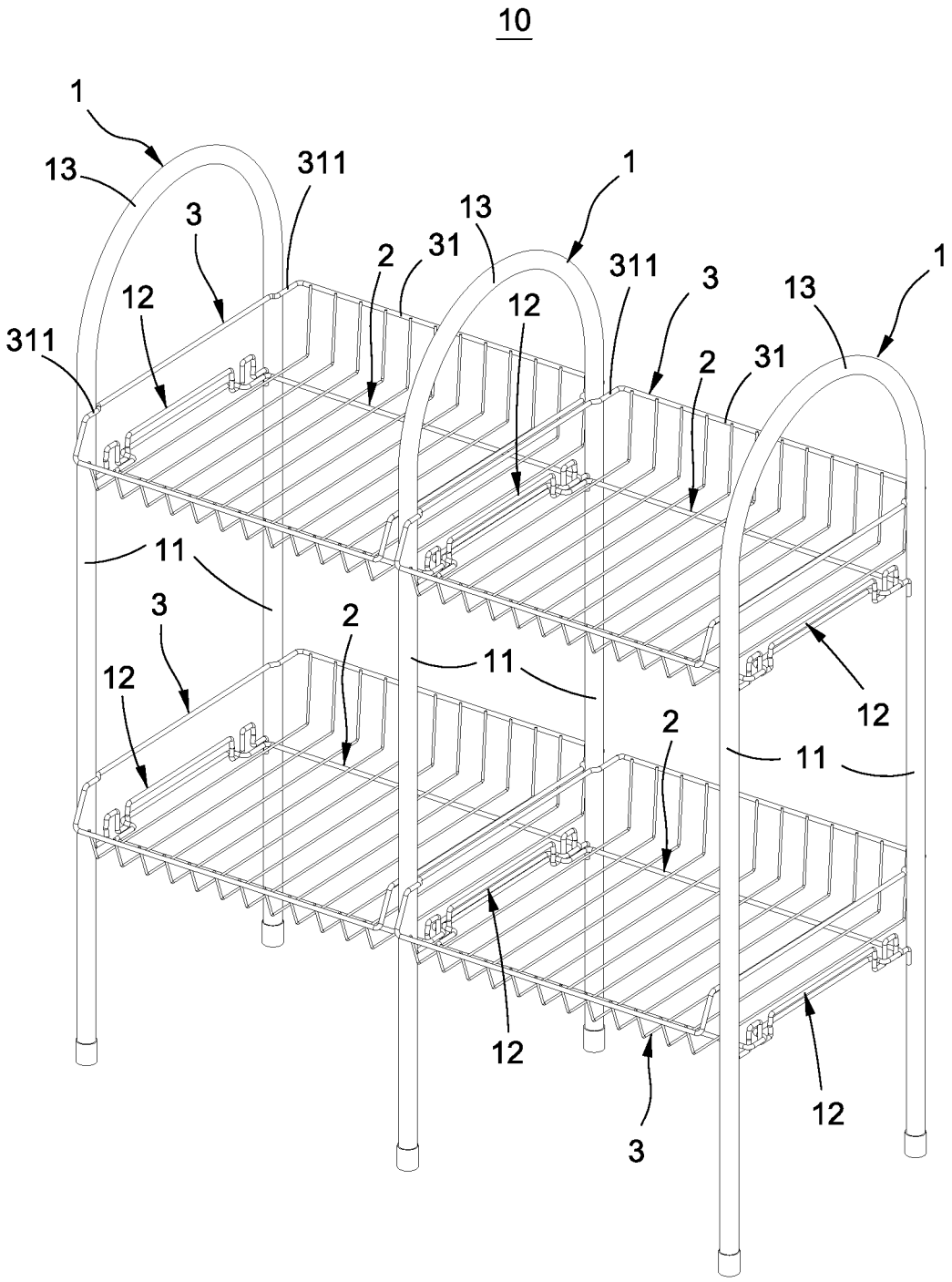
FIG. 7 is a perspective assembled view of the third embodiment of the invention.
Figure 8:
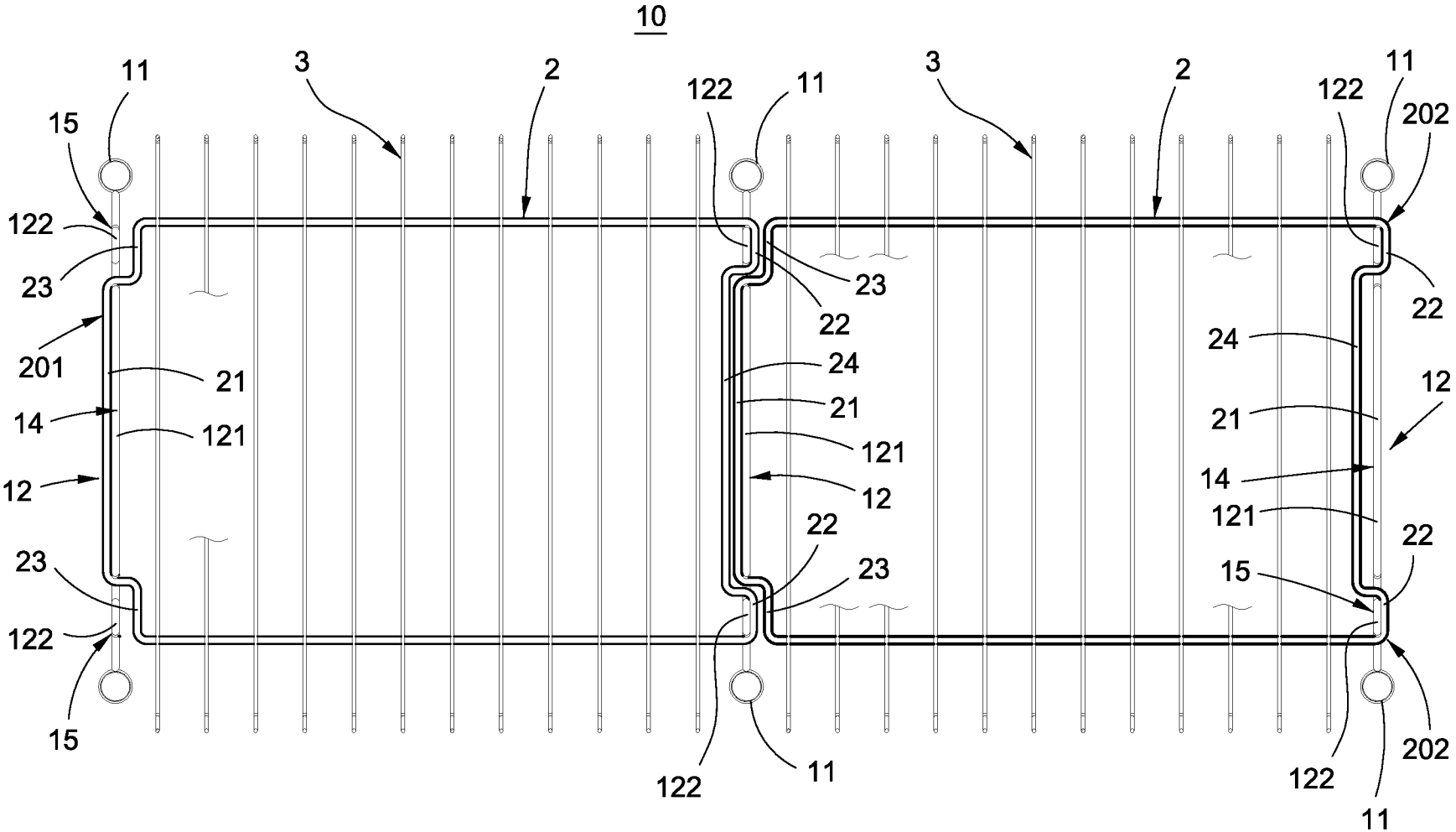
FIG. 8 is a cross-sectional assembled view of the third embodiment of the invention.

Please refer to FIGS. 7-8, which shows the third embodiment of the combinative shelving unit 10 of the invention. The third embodiment is approximately identical to the first embodiment. The third embodiment differs from the first embodiment by the number of the stand assemblies 1 being three.

In detail, the three stand assemblies 1 are arranged to be left and right. The number of the load tray 2 is two or more. The first protrusion section 21 of one of the load trays 2 is embedded into the first inverted-U section 121 of the transverse link 12 which is located at an intermediate position and the two second protrusion sections 22 are separately embedded into the two second inverted-U sections 122 on an outer side. The two second protrusion sections 22 of another load tray 2 are separately embedded into the two second inverted-U sections 122 of the transverse link 12 which is located at an intermediate position, and the first protrusion section 21 is embedded into the first inverted-U section 121 which is located on the other side. Thereby, the three stand assemblies 1 can be horizontally connected to adjust the overall width of the combinative shelving unit 10, and increase the expansibility and variability of the combinative shelving unit 10.

Additionally, conventional shelving units are horizontally expanded only by parallelly placing multiple shelving units. In comparison with conventional shelving, multiple stand assemblies 1 of the invention can be horizontally connected to each other through the load tray 2 to make the combinative shelving unit 10 with enlarged width acquire reinforced structural strength and less components.

Further, the first protrusion section 21 and the two second protrusion sections 22 are staggered in position. Each load tray 2 is provided with two first recess sections 23 at two sides of the first protrusion section 21 for being embedded by the two second protrusion sections 22. Each load tray 2 is provided with one second recess section 24 between the two second protrusion sections 22 for being embedded by the first protrusion section 21. Thereby, when two adjacent load trays 2 are arranged left and right, two second protrusion sections 22 of one of the load trays 2 can be embedded in two first recess sections 23 of another load tray 2, and the first protrusion section 21 of one of the load trays 2 can be embedded in the second recess section 24 of another load tray 2. This makes prevents the assembly of each of the load trays 2 from interfering with each other and affecting their appearance.

Figure 9:
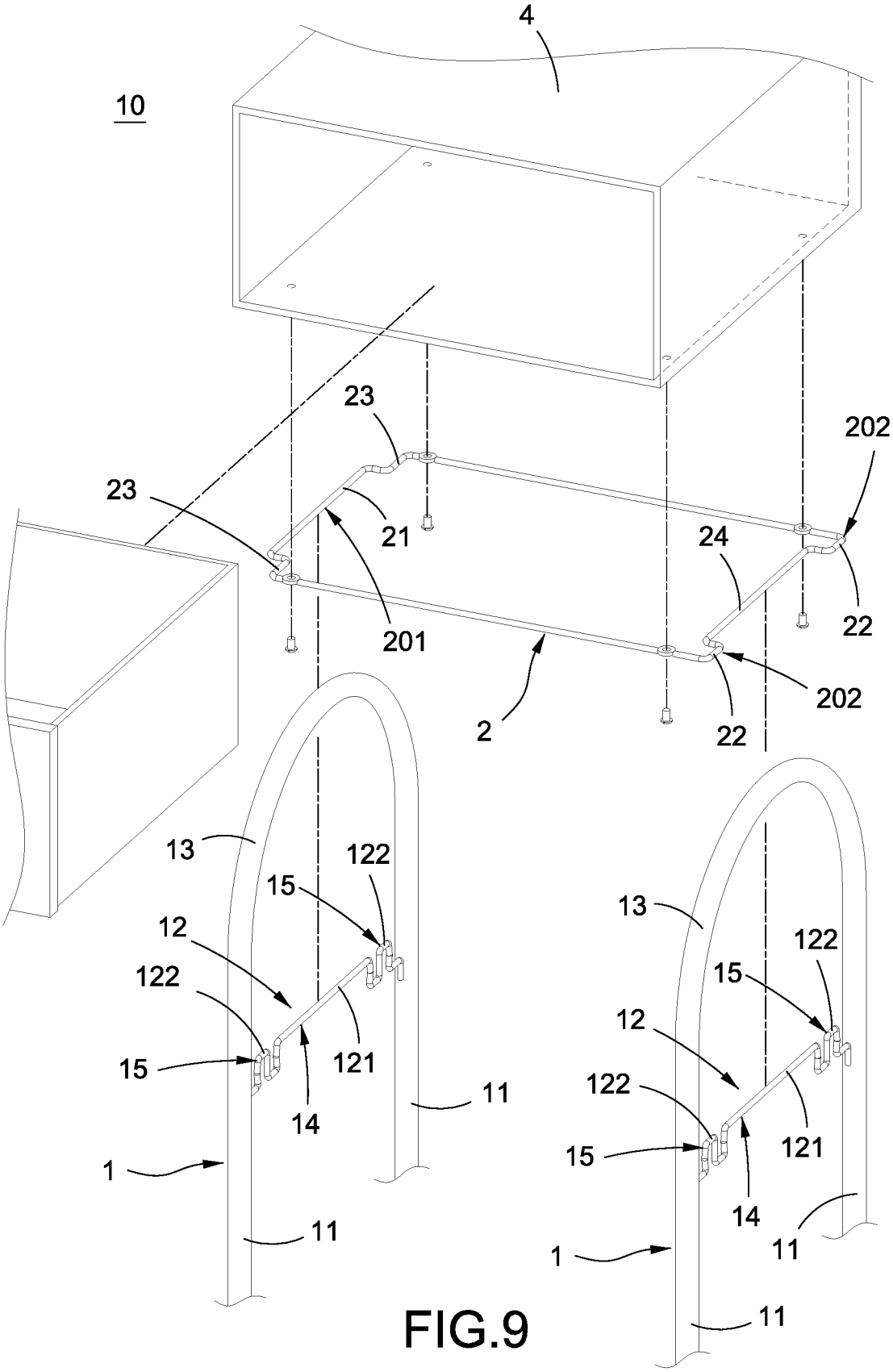
FIG. 9 is a partially exploded view of the fourth embodiment of the invention.
Figure 10:
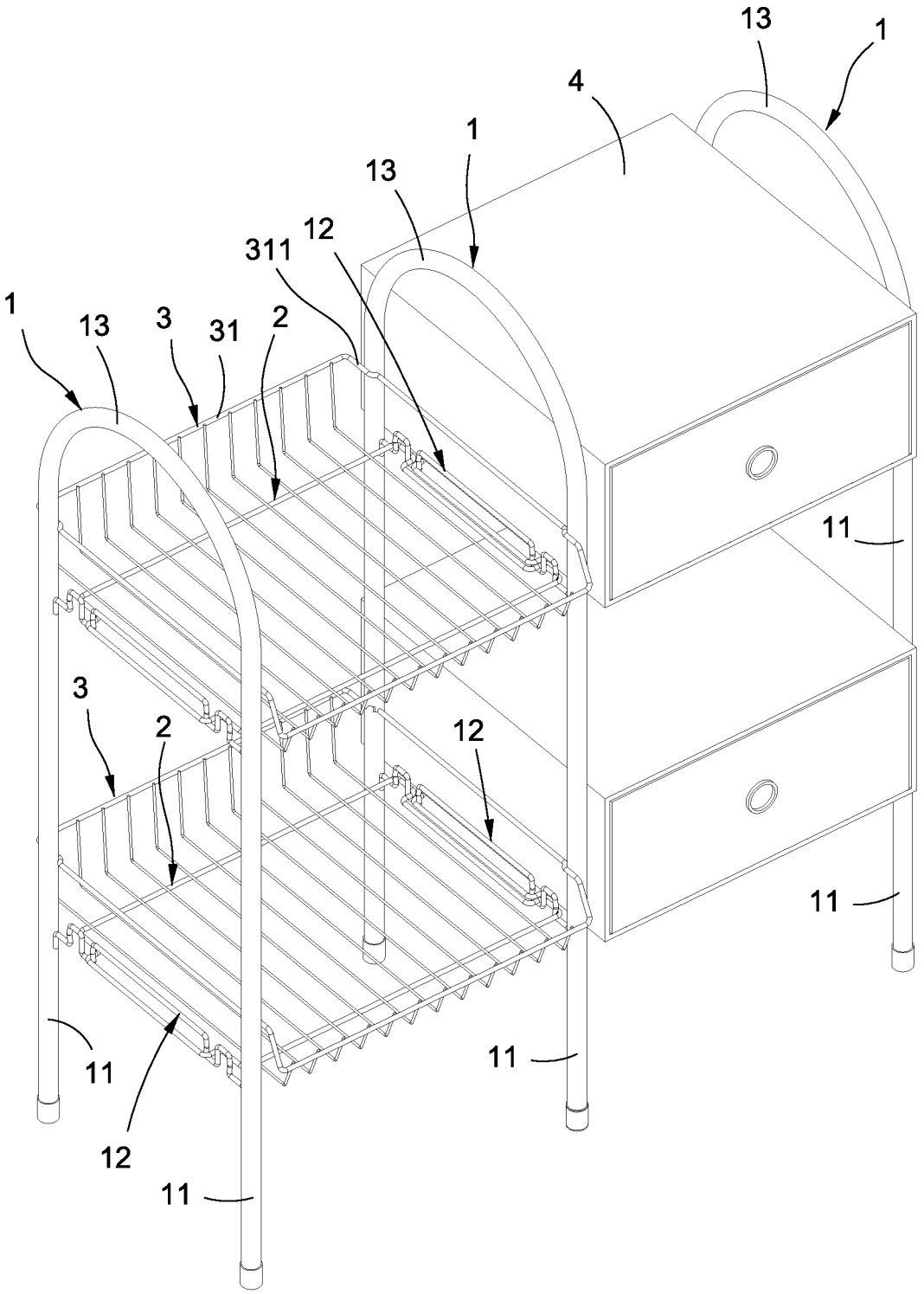
FIG. 10 is a perspective assembled view of the fourth embodiment of the invention.
Figure 11:
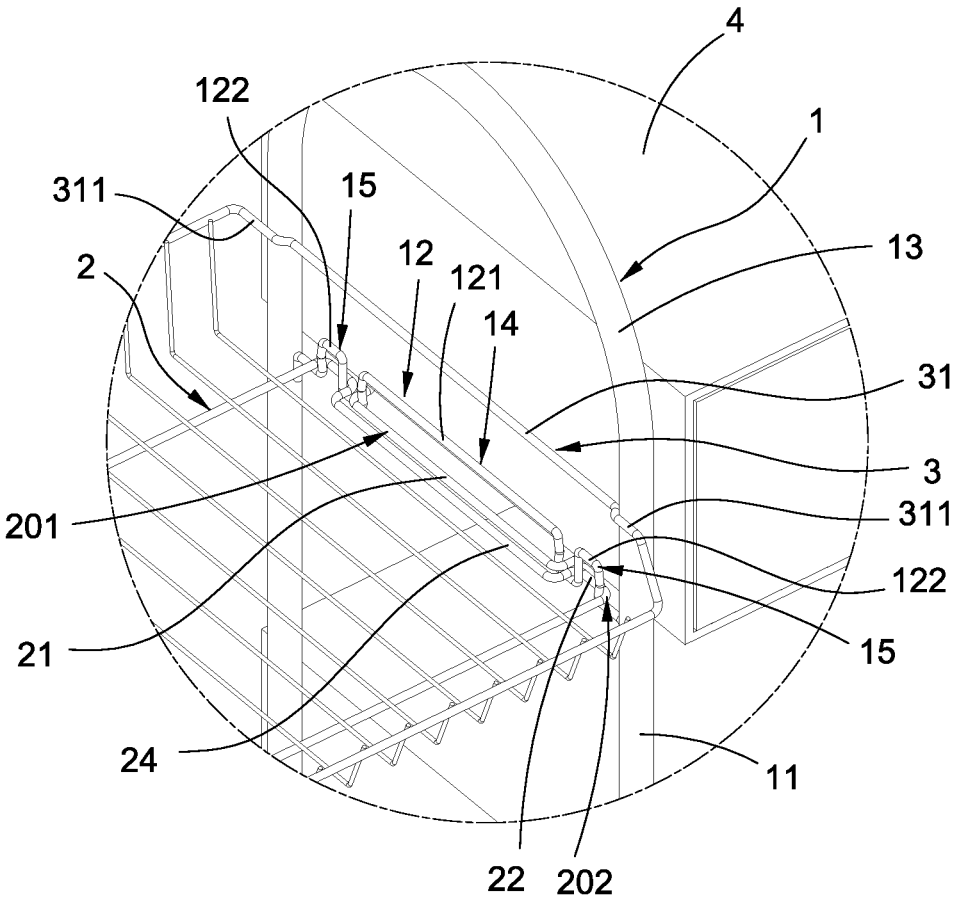
FIG. 11 is a partially enlarged view of the fourth embodiment of the invention.

Please refer to FIGS. 9-11, which shows the fourth embodiment of the combinative shelving unit 10 of the invention. The fourth embodiment is approximately identical to the first embodiment. The fourth embodiment differs from the first embodiment by further including one or more boxes 4. The sum of the numbers of the baskets 3 and boxes 4 is the same as the number of the load trays 2. Each load tray 2 is fixed under the basket 3 or the box 4 by welding or screwing. Thereby, a user can adjust the number or arrangement of the baskets 3 and the boxes 4 to increase the convenience of the combinative shelving unit 10.

The basket 3 is a container without a cover, which is made of interwoven metal wires. The box 4 is a container with a cover, which is formed by plates.

It will be appreciated by persons skilled in the art that the above embodiments have been described by way of example only and not in any limitative sense, and that various alterations and modifications are possible without departure from the scope of the invention as defined by the appended claims.

What is claimed is:

1. A combinative shelving unit comprising:

two stand assemblies, arranged parallel to each other, each comprising a pair of posts and a transverse link connected between the pair of posts, and each transverse link having a first assembling portion and a pair of second assembling portions, each first assembling portion is a first inverted-U section which is bent upward from each transverse link respectively, and the second assembling portions of each transverse link are a pair of second inverted-U sections which are bent upward from each transverse link respectively;

at least one load tray comprising a front, a rear, a first side and a second side opposite the first side, a first protrusion protruding outwardly from the first side and a pair of spaced apart second protrusions protruding outwardly from the second side, the first protrusion being staggered and offset from the second protrusions, the first protrusion is configured to receive the first assembling portion of a first corresponding transverse link therein, and the second protrusions are configured to receive the second assembling portions of a second corresponding transverse link therein.

2. The combinative shelving unit of claim 1, wherein two opposite sides of the first protrusion section of the at least one load tray is formed with a first recess section for receiving one of the second assembling portions of the first corresponding transverse link, and wherein a second recess section is formed between the pair of second protrusions of the at least one load tray for receiving the first assembling portion of the second corresponding transverse link.

3. The combinative shelving unit of claim 2, wherein each stand assembly comprises a U-shaped rod, and each pair of posts is separately formed at two ends of each U-shaped rod respectively.

4. The combinative shelving unit of claim 1, further comprising a basket, which is fastened on the at least one load tray by welding or screwing.

5. The combinative shelving unit of claim 4, wherein the basket has an annular frame disposed on the at least one load tray, and the annular frame abuts against the two pairs of posts.

6. The combinative shelving unit of claim 5, wherein the annular frame is bent to form four indents, which abut against each pair of posts respectively.

7. The combinative shelving unit of claim 1, further comprising a box, and the at least one load tray is fixed under the box.

8. The combinative shelving unit of claim 1, further comprising a third stand assembly, wherein the two stand assemblies and the third stand assembly are three stand assemblies, the three stand assemblies are parallel and horizontally spaced apart, the at least one load tray is at least two load trays, the first protrusion of a first corresponding tray of the at least two load trays is embedded into the first inverted-U section of the first corresponding transverse link which is located at an intermediate position and the second protrusions of the first corresponding tray are separately embedded into the second inverted-U sections of the second corresponding transverse link, the two second protrusion sections of a second corresponding load tray of the at least two load trays are separately embedded into the two second inverted-U sections of a third corresponding transverse link, and the first protrusion of the second corresponding load tray is embedded into the first inverted-U section of the second corresponding transverse link.

9. The combinative shelving unit of claim 1, wherein the two stand assemblies are upper stand assemblies and each pair of posts are upper pairs of posts, wherein two lower stand assemblies each comprising a lower pair of posts are are detachably connected to a bottom end of the upper pair of posts respectively.

10. The combinative shelving unit of claim 9, wherein each bottom ends of the upper posts is a sleeve, wherein top ends of the lower posts comprise insert tubes, and each sleeve is detachably connected with one of the insert tubes.

11. The combinative shelving unit of claim 1, wherein the at least one load tray comprises a plurality of load trays.

* * * * *